United States Patent [19]

Ruscoe et al.

[11] 4,176,014

[45] Nov. 27, 1979

[54] PROCESS FOR THE PRODUCTION OF COIN BLANKS

[75] Inventors: Michael J. H. Ruscoe, St. Albert; Maurice A. Clegg, Fort Saskatchewan; Willie H. Seibt, Edmonton; Kshitindra M. Sarkar, Saskatoon, all of Canada

[73] Assignee: Sherritt Gordon Mines Limited, Toronto, Canada

[21] Appl. No.: 36

[22] Filed: Jan. 2, 1979

[30] Foreign Application Priority Data

Oct. 31, 1978 [CA] Canada ..... 315495

[51] Int. Cl.[2] ..... C25D 7/00; C25D 5/50; C25D 17/20

[52] U.S. Cl. ..... 204/23; 204/37 R

[58] Field of Search ..... 204/23, 25, 37 R, 213

[56] References Cited

U.S. PATENT DOCUMENTS 4,089,753 5/1978 McMullen et al. ..... 204/37 R

*Primary Examiner*—John H. Mack
*Assistant Examiner*—William Leader
*Attorney, Agent, or Firm*—Robert F. Delbridge; Arne I. Fors

[57] ABSTRACT

A process for the production of coin blanks suitable for minting into coins, includes providing metal coin core pieces of disc-like shape each having opposed faces from about 14 mm to about 40 mm in diameter and a face to face thickness of from about 0.5 mm to about 2.6 mm. A charge of core pieces is loaded into a non-conducting perforated container with a diameter of from about 15 cm to about 50 cm, the number of core pieces in the container being such that the core pieces occupy from about ¼ to ½ of the container volume. The container is placed in an electroplating bath, and a metallic cladding is plated on the core pieces, while moving the container angularly about a horizontal axis, at a voltage of from about 6 volts to about 18 volts and a current density of from about 470 $A/m^2$ to about 1400 $A/m^2$ based on the exposed area of the charge, until a plating thickness of from about 0.03 mm to about 0.08 mm of metal has been deposited on each face of each core pieces and a thickness of from about 2 to about 4 times the face thickness has been deposited on the circumference of each core piece. The cladded core pieces are then removed from the container and heated to form a metallurgical bond between the metallic cladding and core piece of each cladded core piece and to reduce the hardness to less than 65 on the Rockwell 30T hardness scale.

2 Claims, No Drawings

PROCESS FOR THE PRODUCTION OF COIN BLANKS

This invention relates to the production of coin blanks suitable for minting into coins, the term "coins" being intended to include not only coins used as currency but similar disc-like articles such as metals and medallions upon which insignia is imprinted.

Because of the escalating value of metals normally used for coins, attempts have been made to develop satisfactory coins which are made of less expensive materials. It has been found that, to be acceptable, coins should have a conventional appearance, since people are reluctant to accept coins of unconventional appearance. Also, because of the vast number of coin-operated vending machines currently in use, it is necessary that a new coin should be acceptable in most current vending machines. Such machines usually include various devices for detecting and rejecting fraudulent replicas of coins such as pieces of metal with the same or similar size and shape as the required coin. Such detection devices may test an inserted object in one or more of several ways, such as by weight, magnetic properties and elasticity, as well as by size and shape. Thus, it is necessary that a new coin should have properties very similar to those of the conventional coin it is intended to replace. Another requirement of course is that a coin should have an adequate working life and should be resistant to excessive wear or other deformation.

Another requirement for a coin blank is that the outer surface must be capable of being satisfactorily imprinted with the desired insignia by suitable dies. If the outer surface of a coin blank is too hard, the imprinting dies themselves may wear away rapidly, and this will increase the cost of production of the coins since the dies are relatively expensive. If the outer surface of a coin blank is too soft, the insignia may rapidly wear away during use of the coin.

U.S. Pat. No. 3,940,254 issued Feb. 24, 1976 relates to a coin blank which satisfies the above requirements, the coin blank having a core piece of low carbon steel, and a continuous cladding of nickel electroplated onto the core so as to completely encase the core, with the coin blank having been annealed to form a metallurgical bond between the core piece and the nickel cladding.

U.S. Pat. No. 4,089,753 issued May 16, 1978 discloses a method of producing such coin blanks by electroplating a relatively large number of metal core pieces with another metal in electroplating equipment conventionally known as barrel plating apparatus. Such apparatus includes a non-conducting perforated container or barrel in which the metal core pieces are contained. The container is positioned in a bath of plating solution and, during the electroplating operation, the container is moved angularly about a horizontal axis with an anode being located in the plating solution outside the container and a cathode contacting the coin blanks being located within the container. The electroplating operation is continued until the metallic cladding has a thickness of at least about 0.05 mm on each face of each core piece and a thickness of at least 2 to 4 times the face thickness on the side edge of each core piece. The cladded core pieces are then removed from the container and are heated to form a metallurgical bond between the metallic cladding and core piece of each cladded core piece.

Before the above mentioned process was invented, barrel plating apparatus was conventionally used for electroplating relatively small thicknesses of nickel or other metal on relatively inexpensive articles such as nuts, bolts and washers. The standard of electroplating required for such inexpensive articles is of course much less than that required for coin blanks. The process conditions described in U.S. Pat. No. 4,089,753 are those normally used in conventional barrel plating apparatus for plating inexpensive articles such as those mentioned above. Although such process conditions do produce satisfactory coin blanks, it has been found that, with certain operating conditions in the barrel plating step, the subsequent annealing operation may not produce a coin blank having an acceptable external surface appearance. Because coin blanks had not previously been produced in barrel plating apparatus prior to the making of the inventions disclosed and claimed in the above mentioned patents, and because barrel plating apparatus had previously been used only for plating articles with which the required standard of plating is not as high as for coin blanks, there is no teaching in the prior art with respect to the necessary operating conditions for producing a metallic cladding of the necessary thickness on coin core pieces in barrel plating apparatus which has the quality required to give satisfactory results in the subsequent annealing step.

It is therefore an object of the invention to provide desired process conditions for the production in barrel plating apparatus of coin blanks which can then be annealed to form a metallurgical bond between the core piece and the metallic cladding of each coin blank and to retain a smooth external surface appearance.

According to the present invention, it has been found that improved cladded coin core pieces are produced in barrel plating apparatus when the non-conducting perforated container has a diameter from about 15 cm to about 50 cm, the core pieces are of disc-like shape with opposed faces from about 14 mm to about 40 mm in diameter and face to face thickness of from about 0.5 mm to about 2.6 mm, the charge (i.e. the number of core pieces in the container) is such that the core pieces occupy from about $\frac{1}{4}$ to about $\frac{1}{2}$ of the container volume, and the plating operation is carried out at a voltage of from about 6 volts to about 18 volts at a current density of from about 470 $A/m^2$ to about 1400 $A/m^2$ based on the exposed area of the charge. The plating operation is carried out under these conditions to produce a plating thickness of from about 0.03 mm to about 0.08 mm on each face of each core piece, with a thickness of from about 2 to about 4 times the face thickness being deposited on the circumference of each core piece.

When the core pieces are of low carbon steel and the metallic cladding is nickel, it has been found that the pH of the plating solution should be less than about 3.5, preferably about 2.2.

The annealing operation will usually be carried out at a temperature of from about 800° to about 1000° C. for a time of about 5 to 40 minutes in a non-oxidizing atmosphere, for example a reducing atmosphere. Besides forming a metallurgical bond between the metallic cladding and the core piece, the annealing operation should also be such that the hardness of the coin blank is decreased to less than about 65, and preferably less than about 45, on the Rockwell 30T hardness scale.

According to one example of the invention, a charge of about 14000 core pieces of steel with a carbon content of about 0.01% was loaded into a non-conducting cylindrical polypropylene barrel with a diameter of 30 cm and a length of 91 cm. Each core piece was 22.6 mm in diameter and 1.3 mm in thickness. The barrel had perforations over the whole of the circumference, the perforations being 9.5 mm in diameter and spaced 8 mm apart, that is to say with approximately 18 mm between the centres of adjacent perforations. The total weight of the core pieces was 50.6 kg, and the core pieces occupied approximately 20% of the barrel volume.

The barrel containing the core pieces was lowered into a plating bath of the following composition:

Ni: 90-110 grams per liter (gpl)

$SO_4^{=}$: 20 gpl $Cl^{-}$: 3 gpl $BO_3^{=}$: 40 gpl The bath had a pH of 2–2.2 and was maintained at a temperature of 55° C. Nickel powder anodes were used, and flexible cathodes were provided in the barrel in contact with the core pieces. During the electroplating operation, the barrel was rotated at 6–7 rpm.

A voltage of 9 V was applied between anode and cathode to produce a current of 200 A. The current density was 700 $A/m^2$ based on the exposed area of the charge, that is to say the area of the top surface of the charge in the barrel plus the total area of the barrel perforations covered by the charge. The plating operation was continued for 36.6 hours to produce a nickel cladding thickness on each face of 0.054 mm and a thickness of 0.143 mm on the circumference of each core piece.

The nickel cladded core pieces were then removed from the container and annealed for 10 minutes at 850° C. in a hydrogen atmosphere. After cooling, the resultant coin blanks were inspected and were found to have a satisfactory metallurgical bond between the nickel cladding and low carbon steel core piece of the blank and a smooth external surface appearance. Further, the hardness of the blanks were less than 45 on the Rockwell 30T hardness scale.

Other embodiments within the scope of the invention will be apparent to a person skilled in the art, the scope of the invention being defined in the appended claims.

What we claim as new and desire to protect by Letters Patent of the United States is:

1. A process for the production of coin blanks suitable for minting into coins, including providing metal coin core pieces of disc-like shape each having opposed faces from about 14 mm to about 40 mm in diameter and a face to face thickness of from about 0.5 mm to about 2.6 mm, loading a charge of core pieces into a non-conducting perforated container with a diameter of from about 15 cm to about 50 cm, the number of core pieces in the container being such that the core pieces occupy from about ¼ to about ½ of the container volume, placing the container in an electroplating bath, electroplating a metallic cladding on the core pieces, while moving the container angularly about a horizontal axis, at a voltage of from about 6 volts to about 18 volts and a current density of from about 470 $A/m^2$ to about 1400 $A/m^2$ based on the exposed area of the charge until a plating thickness of from about 0.03 mm to about 0.08 mm of metal has been deposited on each face of each core piece and a thickness of from about 2 to about 4 times the face thickness has been deposited on the circumference of each core piece, removing the cladded core pieces from the container, and heating the cladded core pieces to form a metallurgical bond between the metallic cladding and core piece of each cladded core piece and to reduce the hardness to less than 65 on the Rockwell 3OT hardness scale.

2. A process according to claim 1 wherein the core pieces are of low carbon steel, the metallic cladding comprises nickel, and the electroplating bath has a pH of less than about 3.5.

* * * * *